US009062831B2

(12) United States Patent
Zhuang

(10) Patent No.: US 9,062,831 B2
(45) Date of Patent: Jun. 23, 2015

(54) LED MODULE WITH IMPROVED COOLING AND LED LAMP WITH LED MODULES DISTRIBUTED THREE-DIMENSIONALLY

(71) Applicant: Optotech (Suzhou) Co., Ltd., Suzhou, Jiangsu (CN)

(72) Inventor: Junyao Zhuang, Suzhou (CN)

(73) Assignee: Optotech (Suzhou) Co., Ltd., Suzhou, Jiangsu (CN)

( * ) Notice: Subject to any disclaimer, the term of this patent is extended or adjusted under 35 U.S.C. 154(b) by 0 days.

(21) Appl. No.: 14/064,061

(22) Filed: Oct. 25, 2013

(65) Prior Publication Data

US 2015/0092415 A1 Apr. 2, 2015

(30) Foreign Application Priority Data

Sep. 29, 2013 (CN) ..... 2013 1 0455743

(51) Int. Cl.

| | |
|---|---|
| ***H05B 41/16*** | (2006.01) |
| ***H01J 63/04*** | (2006.01) |
| ***F21K 99/00*** | (2010.01) |
| ***F21V 29/00*** | (2015.01) |

(52) U.S. Cl.

CPC ..... *F21K 9/50* (2013.01); *F21V 29/2206* (2013.01); *F21V 29/002* (2013.01)

(58) Field of Classification Search

USPC ..... 362/500, 267, 373, 249, 345

See application file for complete search history.

(56) References Cited

U.S. PATENT DOCUMENTS

| | | | | |
|---|---|---|---|---|
| 8,016,458 | B2 * | 9/2011 | Liu et al. | 362/294 |
| 8,492,961 | B2 * | 7/2013 | Zeng | 313/46 |
| 2010/0226137 | A1 * | 9/2010 | Xiao et al. | 362/368 |
| 2012/0257389 | A1 * | 10/2012 | Lai | 362/249.02 |

* cited by examiner

*Primary Examiner* — Tracie Y Green

(74) *Attorney, Agent, or Firm* — Han IP Corporation

(57) ABSTRACT

The present disclosure provides an LED module and an LED lamp made of the same. In one aspect, an LED module includes a base, an LED circuit board fixed on the base, and one or more LED lamp beads located on the LED circuit board, each of the LED lamp beads being provided with one lens disposed on the LED circuit board, the base being provided with a plurality of cooling fins and at least one air convection cooling hole traversing through the base. In another aspect, an LED lamp includes non-planar LED module mounting plate, which is provided with a plurality of said LED modules distributed in different directions in the three-dimensional space. The LED lamp has a higher light utilization rate, greatly improving the illumination uniformity, thus having high light efficiency.

12 Claims, 6 Drawing Sheets

LED MODULE WITH IMPROVED COOLING AND LED LAMP WITH LED MODULES DISTRIBUTED THREE-DIMENSIONALLY

CROSS REFERENCE TO RELATED PATENT APPLICATION

This application claims the priority benefit of China Patent Application No. 201310455743.3, filed 29 Sep. 2013, which is incorporated by reference in its entirety.

TECHNICAL FIELD

The present disclosure relates to a light-emitting diode (LED) module and an LED lamp made of the same, belonging to the field of lighting equipment.

BACKGROUND

Such functional lighting instruments as street lamps and tunnel lamps require that each point within the illuminated zone has luminance that must meet the minimum luminance indicator, the maximum glare requirement indicator, the light intensity uniformity index, and the illuminated zone restriction requirement required by the lighting specification, and also have high requirements on reliability, energy saving, environmental protection and other performances of the products. The existing street lamps and tunnel lamps widely have a problem that the light irradiated to the ground has poor luminance uniformity. To improve the lighting effect and protect health of the human eye, lamps must be utilized for lighting configuration of the optical system; that is, a light field of uniform luminance is provided by light irradiation at a specified road position and within a given road zone, with the light irradiated outside the specified zone considered to be invalid.

The existing LED lamps widely have a problem that the heat produced during work cannot be dissipated timely and is likely to cause heat accumulation, with a lot of heat produced during long hours of work easily causing such negative phenomena as fading of light of the LED lamp, thereby affecting lifetime of the LED lamp. Some of the LED lamps are used in outdoor environment and thus may be affected with damp in the rain, wind and snow weather, and the circuit boards inside the LED lamps are easy to get short circuit caused by water vapor to thus make the LED lamps burnt and so on.

Besides, for the traditional LED lamps, all the LED lamp beads thereon are arranged on a piece of LED circuit board having a large area and a planar plate shape, where these LED lamp beads can only be placed in the same plane and the light emitted by each of the lamp beads may overlap in a wide range in the air. As a result, in a target illuminated zone, some places are very dark because only a small part of the light is projected over, while other places are very bright because a big part of the light is projected over, thus resulting in very obvious light spots in the target illuminated zone and very poor irradiation uniformity. Then a sufficient number of LED lamp beads and large enough luminous power have to be used to make each place of the target illuminated zone get the required light intensity, thus exhausting a great deal of electric power.

SUMMARY

A purpose of the present disclosure is, for the above problems, to provide an LED module and an LED lamp made of the same.

The present disclosure adopts the following technical solution: An LED module, comprising a base, an LED circuit board fixed on the base, and one or more (e.g., 1-8) LED lamp beads located on the LED circuit board, each of the LED lamp beads being provided outside with one lens fixed on the LED circuit board, the base being provided with a plurality of cooling fins and at least one air convection cooling hole traversing through the base.

Preferably, the base is provided on its upper part with an LED circuit board mounting slot, in which is fixed the LED circuit board by sealing with viscous sealant, the cooling fin being located at the bottom of the base.

Preferably, the base is made of aluminum.

Preferably, the LED circuit board is provided totally with three LED lamp beads, which are distributed on the LED circuit board at a linear interval.

Preferably, the base, having a rectangular external contour, is provided totally with two air convection cooling holes, and provided with an external thread around the outside of the air convection cooling hole.

Preferably, the LED circuit board is provided totally with six LED lamp beads, which are distributed on the LED circuit board in a regular hexagon form.

Preferably, the base, having an external contour of a regular hexagonal prism, is provided totally with six air convection cooling holes, which are disposed on the six edges of the regular hexagonal prism, respectively.

Preferably, the base is provided at its central bottom with a threaded hole.

Preferably, beam angles of all the lenses fixed on the LED circuit board are not the same, or partially the same, or all the same.

An LED lamp, comprising a lamp holder, the lamp holder is provided with at least one non-planar LED module mounting plate, which is provided densely with a plurality of through holes distributed in all directions in the three-dimensional space; the LED module mounting plate is fixedly provided with a plurality of LED modules, all the lenses on these LED modules going through out of the through hole and distributed in all directions in the three-dimensional space, the air convection cooling hole on these LED modules being connected to the through hole.

Preferably, the lamp holder is composed of a front seat body and a rear seat body hinged to each other, as well as an electrical element mounting cavity formed therebetween, the front seat body being provided densely with cooling holes, the LED module mounting plate being formed on the front seat body.

Preferably, the LED module mounting plate is of an arc shape, a spherical shape, a wave shape, or a multi-angle bent surface shape.

The present disclosure has the following advantages: Firstly, the LED module is light and small and has extremely strong cooling and waterproof performance, allowing to be independently used as a single light source. Secondly, with the LED lamp made of the LED module, the angle of the emitted light is big, and the light energy of the LED light source can be fully utilized, thus having high light efficiency, achieving the small power required by illumination, and being energy-saving and environmental protective. Thirdly, with the LED lamp made of the LED module, the LED lamp beads on the LED lamp can be distributed in any direction in the three-dimensional space, instead of being limited to distribution in the same plane any more. Therefore, this LED lamp has a higher light utilization rate, and can directionally control light intensity distribution of the LED lamps, thus greatly improving the illumination uniformity, and having no blind zones, light spots, or glare in the target illuminated zone, safe and healthy.

BRIEF DESCRIPTION OF THE DRAWINGS

The present disclosure will further be described below with reference to drawings and examples.

Numeral references used in the figures identify the following objects related to the present disclosure: 1—base, 2—lens, 3—air convection cooling hole, 4—threaded hole, 5—fin, 6—lamp holder, 7—LED module mounting plate, 8—through hole, 9—front seat body, 10—rear seat body, 11—cooling hole, and 12—screw connection hole.

DETAILED DESCRIPTION OF THE PREFERRED EMBODIMENTS

Example 1

As shown in FIGS. 1-4, this LED module provided by this example, being very light and small, comprises a base 1, an LED circuit board fixed on the base (not shown in the diagram), and three LED lamp beads located on the LED circuit board (not shown in the diagram), which are distributed on the LED circuit board at a linear interval, each of the LED lamp beads being provided outside with one lens 2 fixed on the LED circuit board. Besides, the base 1 is provided with a plurality of cooling fins 5 and two air convection cooling holes 3 traversing through the base, so as to ensure that this LED module has good cooling performance; and the base 1 in this example is made of aluminum material having good cooling performance.

Figure 1:
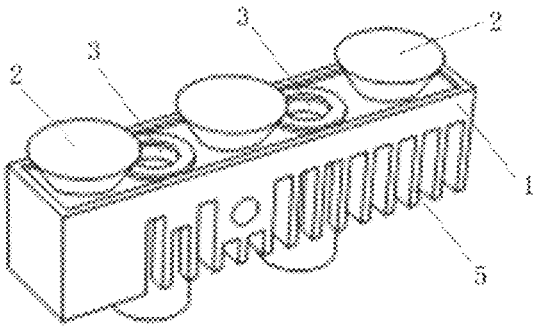
FIG. 1 is a stereoscopic diagram of the LED module in Example 1 of the present disclosure.

In this example, the base 1 has a rectangular external contour, as shown in FIG. 1.

In this example, beam angles of all the lenses 2 fixed on the LED circuit board can be not the same, or partially the same, or all the same, and can specifically be chosen according to needs, such as 30 °, 60° and 80°.

In order to ensure the position stability of the LED circuit board on the base 1, in this example the base 1 is provided on its upper part with an LED circuit board mounting slot, in which is fixed the LED circuit board; besides, in this example viscous sealant is further provided to seal the LED circuit board into the LED circuit board mounting slot, so as to completely insulate the LED circuit board from the outside air and achieve the best waterproof performance. Besides, this structural design of the LED circuit board mounting slot can also increase the contact area of the LED circuit board with the base 1, so as to make the heat of the LED circuit board delivered quickly to the base 1 and then dissipated out by the base 1. The cooling fin 5 is located at the bottom of the base 1.

In this example, the base 1 is provided with an external thread around the outside of the air convection cooling hole 3, such that this LED module can directly be fixed to a supporting frame through the external thread thereon and used alone as a light-emitting lamp.

This LED module provided by this example is very light and small (it is provided only with three LED lamp beads), and has excellent cooling performance. Thus the inventor considers that if a plurality of the LED modules of such structure are distributed in all directions in the three-dimensional space to form a new LED lamp, the phenomenon of overlapping of the light emitted by each of the LED lamp beads in the air will be greatly reduced; so long as each of the LED modules is reasonably distributed in the space, the light emitted by each of the LED lamp beads can be utilized to the uttermost extent, thus greatly improving illumination uniformity of the target illuminated zone, making the light spots disappear, and reducing waste of light. Based on this idea, the inventor designed an LED lamp as shown in FIGS. 5-8, which is mainly made of a plurality of the above LED modules; the LED lamp comprises a lamp holder 6 that is provided with at least one non-planar LED module mounting plate 7, which is provided densely with a plurality of through holes 8 distributed in all directions in the three-dimensional space; on the LED module mounting plate 7 are fixedly mounted a plurality of the above LED modules, all the lenses 2 (not shown in FIGS. 5-8) on which go through out of the through hole 8 (so as to provide illumination light emitted outward) and are distributed in all directions in the three-dimensional space; besides, the air convection cooling hole 3 on these LED modules is connected to the through hole 8, so as to ensure that the air convection cooling hole 3 is connected to the outside atmosphere and thus has its cooling performance put into effect.

Figure 2:
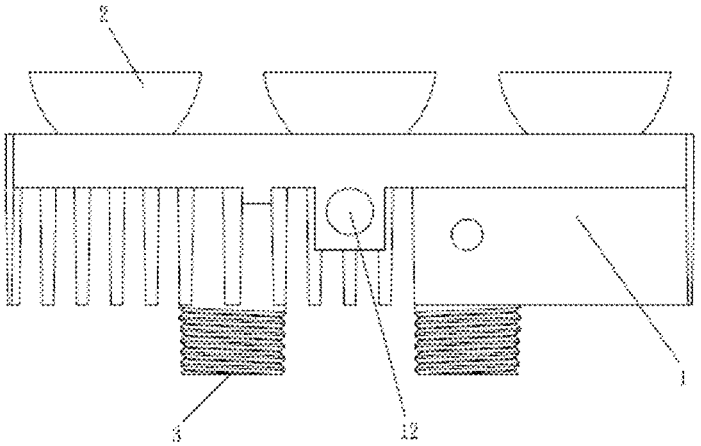
FIG. 2 is a main view of the LED module in Example 1 of the present disclosure.
Figure 3:
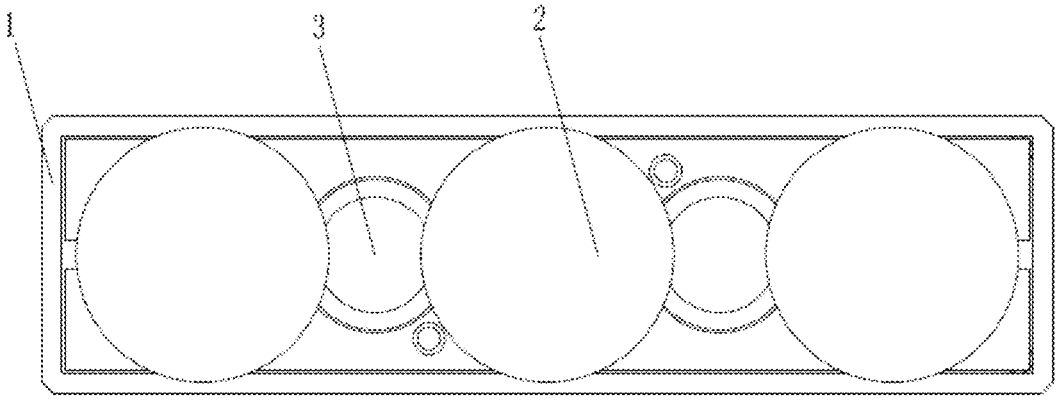
FIG. 3 is a top view of FIG. 2.
Figure 4:
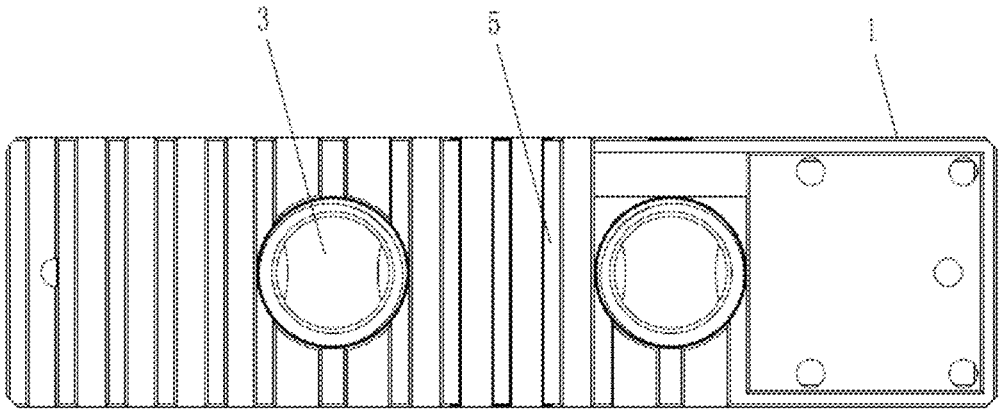
FIG. 4 is a bottom view of FIG. 2.
Figure 5:
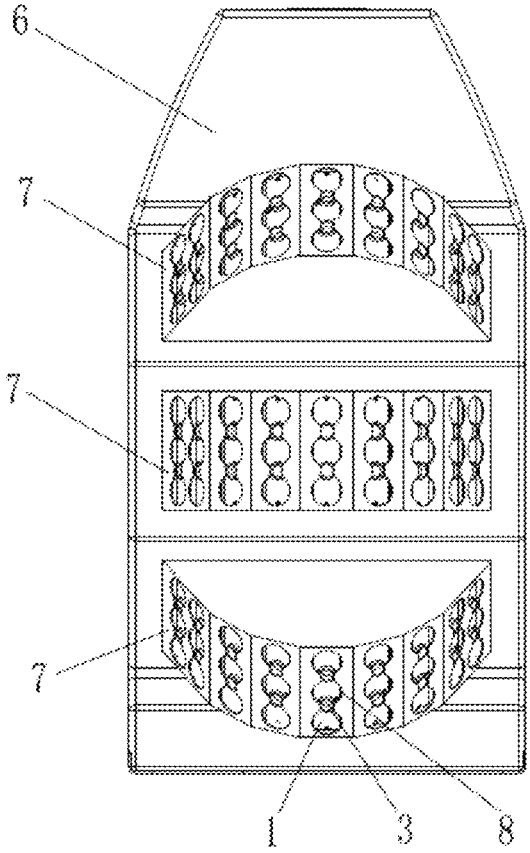
FIG. 5 is a main view of the LED lamp in Example 1 of the present disclosure.
Figure 6:
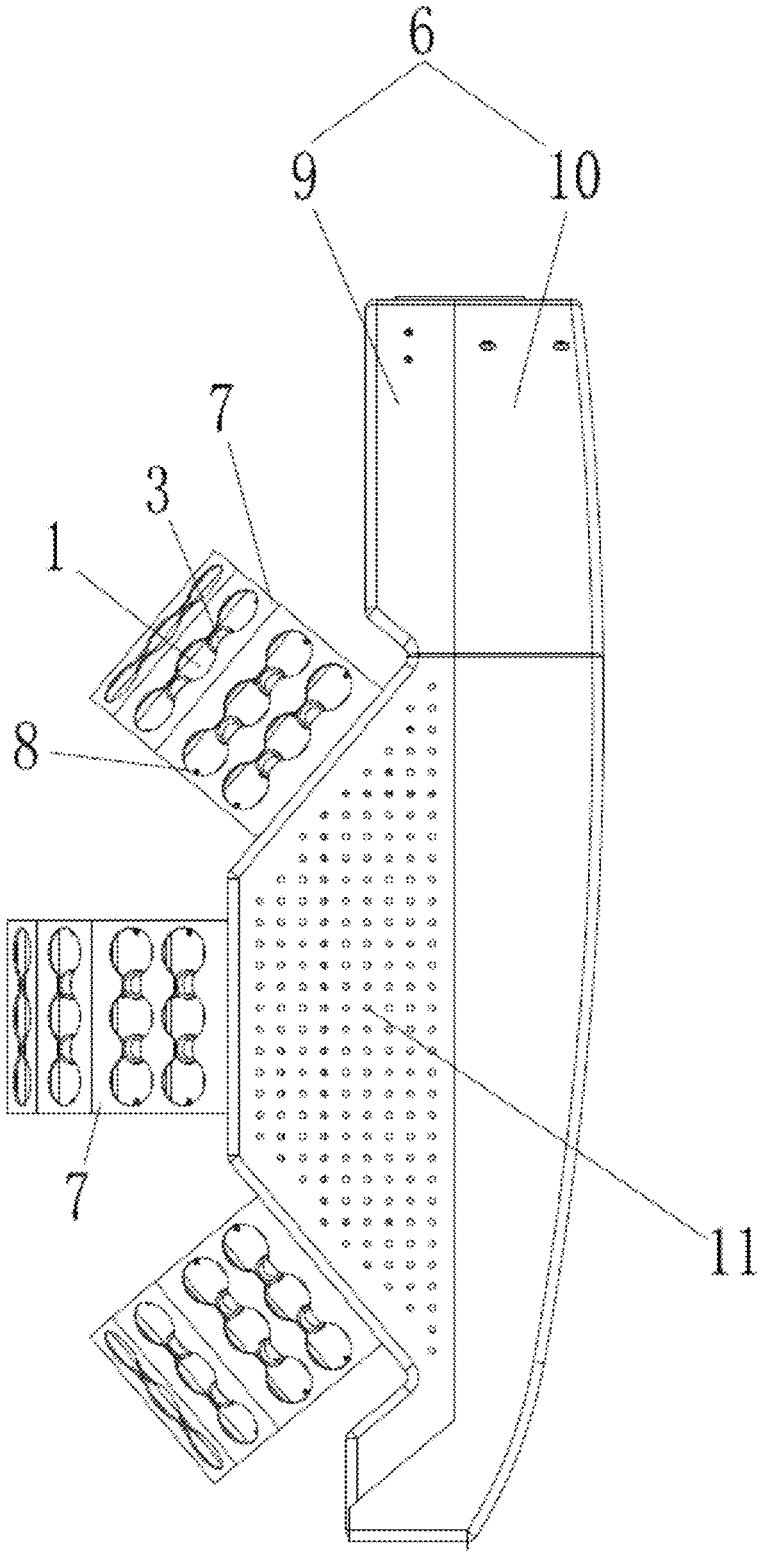
FIG. 6 is a right view of FIG. 5.
Figure 7:
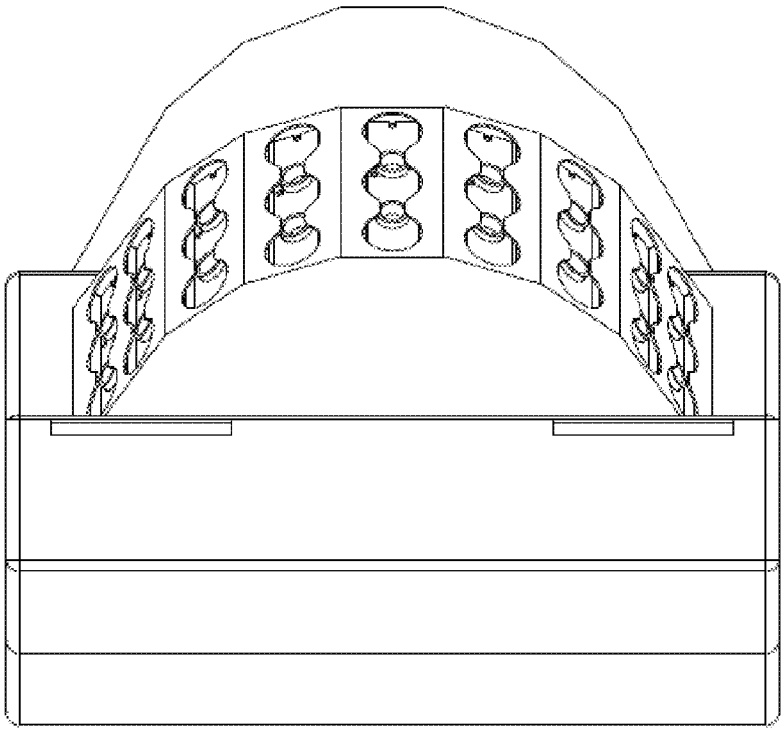
FIG. 7 is a bottom view of FIG. 5.
Figure 8:
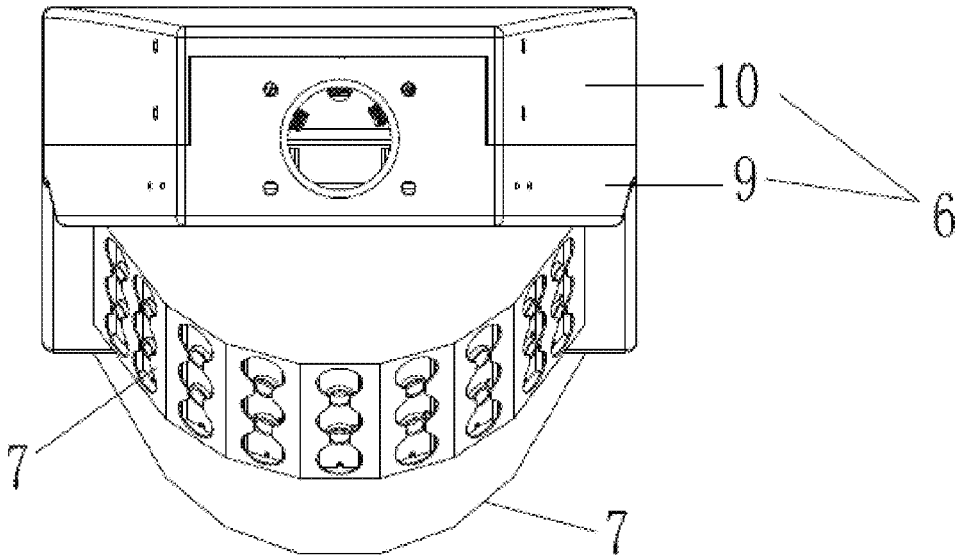
FIG. 8 is a top view of FIG. 5.
Figure 9:
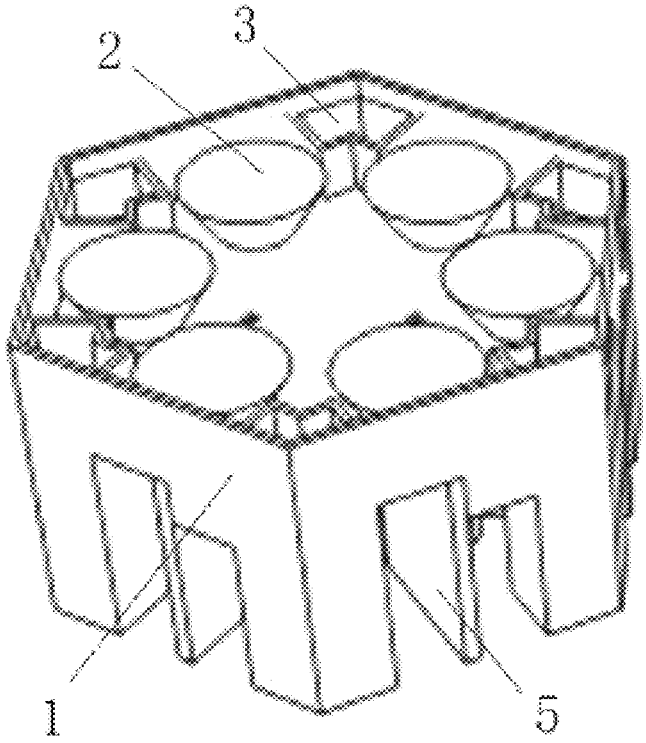
FIG. 9 is a perspective view of the LED module in Example 2 of the present disclosure.
Figure 10:
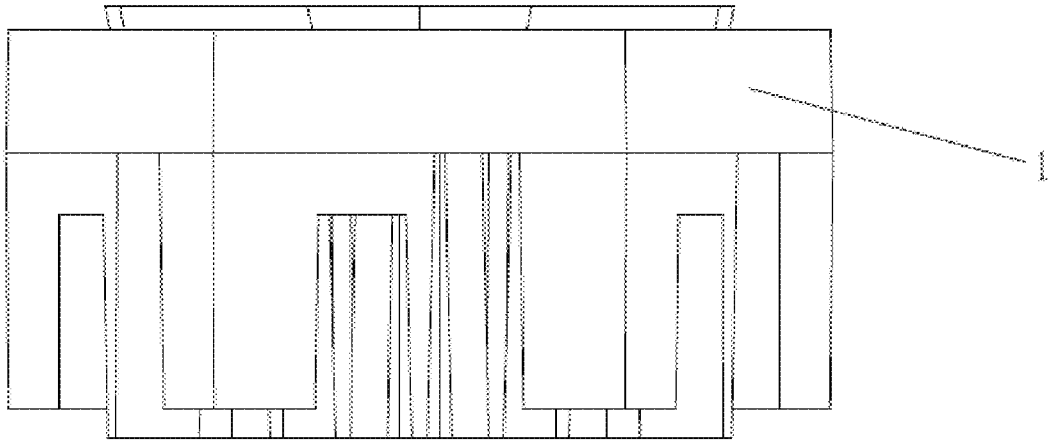
FIG. 10 is a main view of the LED module in Example 2 of the present disclosure.
Figure 11:
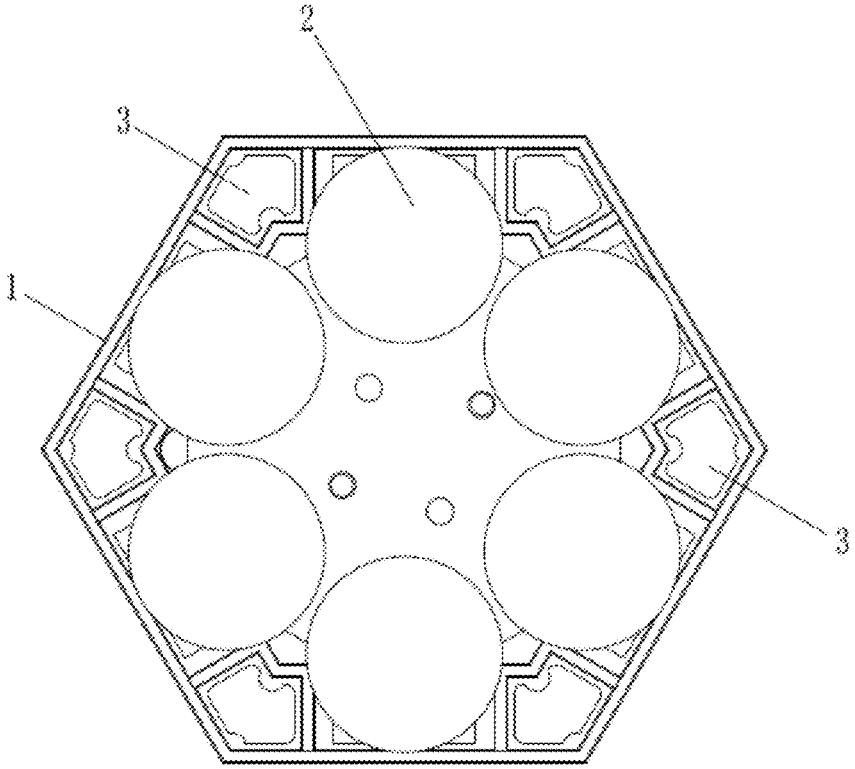
FIG. 11 is a top view of FIG. 9.
Figure 12:
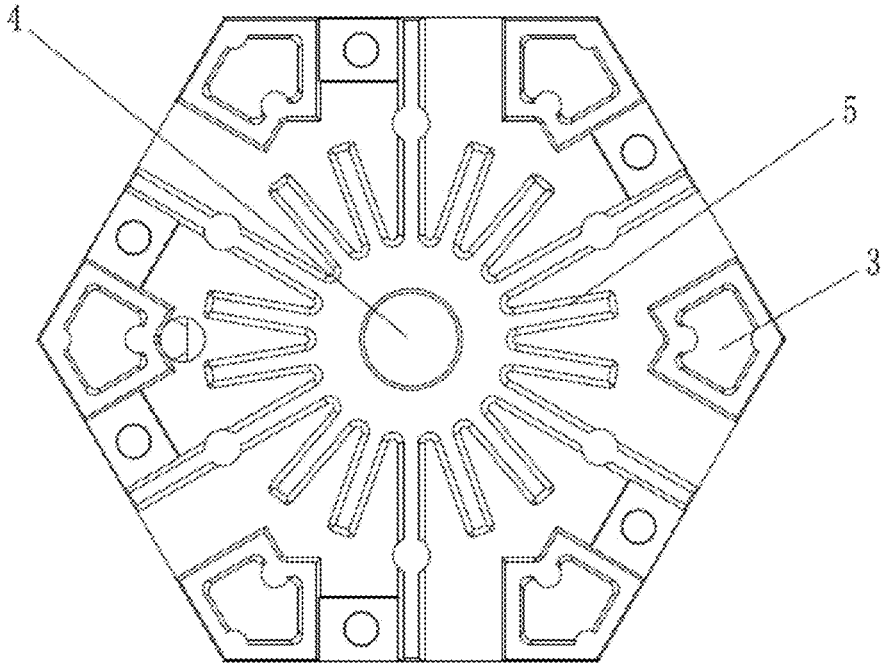
FIG. 12 is a bottom view of FIG. 9.

The LED module can be fixedly mounted either with screws or by snap on the LED module mounting plate 7. In this example, the LED module is fixedly mounted on the LED module mounting plate 7 with screws, and provided with the corresponding screw connection hole 12, as shown in FIG. 2.

In this example, the lamp holder 6 is composed of a front seat body 9 and a rear seat body 10 hinged to each other, as well as an electrical element mounting cavity formed therebetween, the LED module being arranged inside the electrical element mounting cavity (the lens portion thereon extends outside the through holes), the LED module mounting plate 7 being formed on the front seat body 9. The lamp holder 6 adopts this structure for facilitating assembly of this LED lamp; when assembling, first reversing and unfolding the front seat body 9 and the rear seat body 10 mutually hinged together, then fixing each of the LED modules at the inside of the LED module mounting plate 7, and then mounting other required electrical elements (e.g. a leading wire), and finally snapping the front seat body 9 and the rear seat body 10 together and getting them locked.

In this example, the front seat body 9 is provided densely with a plurality of cooling holes 11, so as to further improve the cooling performance of this LED lamp.

The LED module mounting plate 7 is of an arc shape, a spherical shape, a wave shape, or a multi-angle bent surface shape, etc., and can also be of various combinations of an arc shape, a spherical shape, a wave shape and a plane, with the specific shape selected as required by lighting configuration.

The following parameters need to be determined according to the actual requirements in this example for this LED lamp in the fabrication and installation process: the number of the LED modules, the shape of the LED module mounting plate, the three-dimensional spatial position of each of the LED modules, the luminous power of each of the LED modules, and the beam angle of each of the lenses. Each of the LED lamp beads on this LED lamp of this example can be distributed in any direction in the three-dimensional space, thus allowing reduction of overlapping of light of the lamp bead, thereby greatly improving light uniformity of the target illuminated zone and reducing luminous power of the LED lamp.

In the actual application, in order to achieve the better light uniformity, the maximum distance between the two LED modules can be calculated according to the formula of $$d_{max} = \sqrt{\frac{4}{m+3}} * z,$$

where: $d_{max}$ is the maximum distance between the two LED modules; z is the irradiation distance, i.e. the distance between the LED module and the target illuminated zone; m is a constant, specifically $$m = \frac{-\ln 2}{\ln \cos(\theta_{1/2})},$$

where θ is a beam angle of the LED module. That is, the maximum distance between the two LED modules can be determined according to the beam angle θ of the LED module, as well as the distance between the LED module and the target illuminated zone. Then the light-emitting surface curvature and the installation angle of the LED lamps are regulated according to the installation height of the actual LED lamps and the range to be irradiated.

Case: For a high pole lamp on a high-speed parking lot, it was found by measurement and DIALUX optical simulation that the light uniformity of the target illuminated zone was only 0.29, with the light spot very obvious; while after using the LED lamp of this structure of this example, it was found that the target illuminated zone had a very pale light spot, with the light uniformity also improved significantly to reach the level of 0.43.

Example 2

As shown in FIGS. 9-12, the structure of this LED module provided by this example is similar to that in Example 1, with the main difference in the following aspects:

a. In this example, the base 1, having an external contour of a regular hexagonal prism, is provided thereon with six air convection cooling holes 3 going through this base, which are disposed on the six edges of the regular hexagonal prism, respectively.

b. The LED circuit board is provided with six LED lamp beads (not shown in the diagram), which are distributed on the LED circuit board in a regular hexagon form.

c. The base 1 in this example was not provided with an external thread around the outside of the air convection cooling hole 3, but provided at its central bottom with a threaded hole 4. The purpose of such a design is identical to that of the external thread around outside the air convection cooling hole 3 in Example 1: both for fixing this LED module directly on a support with the thread of the threaded hole 4 and using it alone as a light-emitting lamp.

The number of the LED lamp beads arranged on the LED circuit board is not limited to 3 or 6, and can also be 1, 2, 4 or 5; considering that the LED lamp made of this LED module cannot be over large, the number of the LED lamp beads arranged on a general LED circuit board is preferably 1-8.

Certainly, this LED module of this example can likewise be used for manufacturing the LED lamp having a structure similar to that of Example 1, and can also be combined and used together with that in Example 1 on one and the same LED lamp.

The above examples are used only for explaining the technical concept and characteristics of the present disclosure, aiming to allow people to understand the contents of the present disclosure and thereby implement it, instead of limiting the scope of protection of the present disclosure. Any equivalent alteration or modification made according to the spirit of the main technical solution of the present disclosure will all fall within the scope of protection of the present disclosure.

What is claimed is:

1. A light-emitting diode (LED) module, comprising:

a base, the base being provided with a plurality of cooling fins and more than one air convection cooling hole traversing through the base;

an LED circuit board disposed on the base; and a plurality of LED lamp beads disposed on the LED circuit board, each of the plurality of LED lamp beads being provided with a corresponding lens on the LED circuit board, wherein each of the more than one air convection cooling hole is disposed between respective two adjacent LED lamp beads of the plurality of LED lamp beads.

2. The LED module of claim 1, wherein an upper part of the base includes an LED circuit board mounting slot in which is fixed the LED circuit board by sealing with viscous sealant, and wherein the cooling fins are located at a bottom part of the base opposite the upper part thereof.

3. The LED module of claim 2, wherein the base is made of aluminum.

4. The LED module of claim 1, wherein the LED circuit board is provided with three LED lamp beads which are distributed on the LED circuit board with a linear interval.

5. The LED module of claim 4, wherein the base, having a rectangular external contour, is provided with two air convection cooling holes, and wherein the base is provided with an external thread around an outside of the air convection cooling hole.

6. The LED module of claim 1, wherein the LED circuit board is provided with six LED lamp beads which are distributed on the LED circuit board in a regular hexagon form.

7. The LED module of claim 6, wherein the base, having an external contour of a regular hexagonal prism, is provided with six air convection cooling holes which are disposed on six edges of the regular hexagonal prism, respectively.

8. The LED module of claim 1, wherein the base is provided at its central portion with a threaded hole.

9. The LED module of claim 1, wherein beam angles of the lenses disposed on the LED circuit board are not the same, partially the same, or all the same.

10. A light-emitting diode (LED) lamp, comprising:

a lamp holder, wherein the lamp holder including at least one non-planar LED module mounting plate which is provided densely with a plurality of through holes distributed in different directions three-dimensionally, the LED module mounting plate fixedly provided with a plurality of LED modules each of which respectively comprising:

a base, the base being provided with a plurality of cooling fins and at least one air convection cooling hole traversing through the base;

an LED circuit board disposed on the base; and one or more LED lamp beads disposed on the LED circuit board, each of the one or more LED lamp beads being provided with a corresponding lens on the LED circuit board, wherein the lenses on these LED modules correspond to the respective through holes and are distributed in different directions three-dimensionally, and wherein the respective air convection cooling hole on each of the LED modules is connected to the respective through hole.

11. The LED lamp of claim 10, wherein the lamp holder comprises a front seat body and a rear seat body hinged to each other with an electrical element mounting cavity formed therebetween, the front seat body being provided densely with cooling holes, the LED module mounting plate being formed on the front seat body.

12. The LED lamp of claim 11, wherein the LED module mounting plate is of an arc shape, a spherical shape, a wave shape, or a multi-angle bent surface shape.

* * * * *